US005732752A

United States Patent [19]

Glessner et al.

[11] Patent Number: 5,732,752

[45] Date of Patent: Mar. 31, 1998

[54] METHOD AND APPARATUS FOR THE AUTOMATIC RELEASE OF A GAS FROM A PRESSURIZED CARTRIDGE

[76] Inventors: Glen R. Glessner, W. 9145 Thompson Rd., Coeur d'Alene, Id. 83814; George M. Glessner, 381 W. Ponderosa, Yakima, Wash. 98903; Aime A. Gehri, 4 N. 41st Ave., Yakima, Wash. 98908

[21] Appl. No.: 628,002

[22] Filed: Apr. 4, 1996

[51] Int. Cl.[6] ..... B65B 1/04

[52] U.S. Cl. ..... 141/329; 141/19; 141/114; 141/330; 141/313; 222/5; 116/210; 116/DIG. 8; 116/DIG. 9; 244/33

[58] Field of Search ..... 141/19, 114, 329, 141/330, 313; 222/5; 128/200.23, 203.21, 205.21; 116/210, DIG. 8, DIG. 9; 244/33; 441/92–94

[56] References Cited

U.S. PATENT DOCUMENTS

| | | | |
|---|---|---|---|
| 2,702,600 | 2/1955 | Allen | 141/19 |
| 3,017,907 | 1/1962 | Quail et al. | 141/197 |
| 3,023,932 | 3/1962 | Hennis et al. | 222/5 |
| 3,132,626 | 5/1964 | Reid | 116/124 |
| 3,216,466 | 11/1965 | Simko | 141/226 |
| 3,381,655 | 5/1968 | Rozzelle | 116/124 |
| 3,526,202 | 9/1970 | Graulich | 116/124 |
| 3,721,983 | 3/1973 | Sherer | 343/18 B |
| 3,727,229 | 4/1973 | Clinger | 343/706 |
| 3,735,723 | 5/1973 | Lutz | 116/124 B |
| 3,811,461 | 5/1974 | Novak | 222/5 |
| 3,834,433 | 9/1974 | Thompson | 141/392 |
| 3,924,654 | 12/1975 | Buller | 137/322 |
| 3,941,079 | 3/1976 | McNeill | 116/124 B |
| 4,013,035 | 3/1977 | Kopeika | 116/124 B |
| 4,114,561 | 9/1978 | Asaro | 116/124 B |
| 4,185,582 | 1/1980 | Bryant | 116/210 |
| 4,295,438 | 10/1981 | Porter | 116/210 |
| 4,546,956 | 10/1985 | Moberg | 251/149.6 |
| 4,586,456 | 5/1986 | Forward | 116/210 |
| 4,787,575 | 11/1988 | Stewart | 244/33 |
| 4,815,677 | 3/1989 | Rushing et al. | 244/33 |
| 4,836,128 | 6/1989 | Walker | 716/210 |
| 4,917,041 | 4/1990 | Welswurm | 116/210 |
| 4,944,242 | 7/1990 | Russell | 116/210 |
| 5,020,467 | 6/1991 | Patten | 116/210 |
| 5,049,106 | 9/1991 | Kim | 446/220 |
| 5,199,374 | 4/1993 | Blanchette | 116/209 |
| 5,301,631 | 4/1994 | Vining | 116/210 |

*Primary Examiner*—Henry J. Recla
*Assistant Examiner*—Steven O. Douglas
*Attorney, Agent, or Firm*—Stratton Ballew

[57] ABSTRACT

A method and apparatus for automatically releasing a gas from a pressurized cartridge of the gas is provided, especially for the purpose of inflating an emergency balloon. The apparatus includes an automatic signal balloon inflator, having a support structure, an upper surface and a bottom plate. The bottom plate has at least a single cartridge mount, each with a vent and a pin port. The pin port connects to the cartridge mount. At least a single pressurized cartridge, containing a gas stored under pressure, is received into each cartridge mount in the support structure. A spring loaded piston is mounted upon the support structure. A plunger with a piston contact surface and a puncture pin is forced by the spring loaded piston to depress and penetrate the pressurized cartridge, releasing the gas contents of the pressurized cartridge through the vent. A firing spring forces the piston to engage the plunger. The emergency or signal balloon inflator also has a lightweight and reliable self-sealing one-way valve that, after the balloon is filled, can snap off from the support structure. The emergency balloon inflator also has tether, which feeds a line to the balloon with a minimum possibility of knots and tangles.

13 Claims, 8 Drawing Sheets

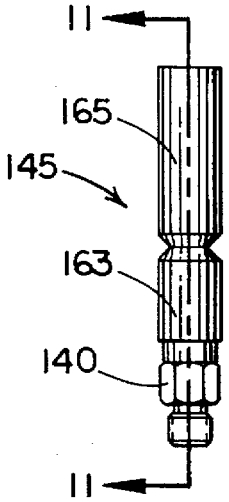
FIG. 10
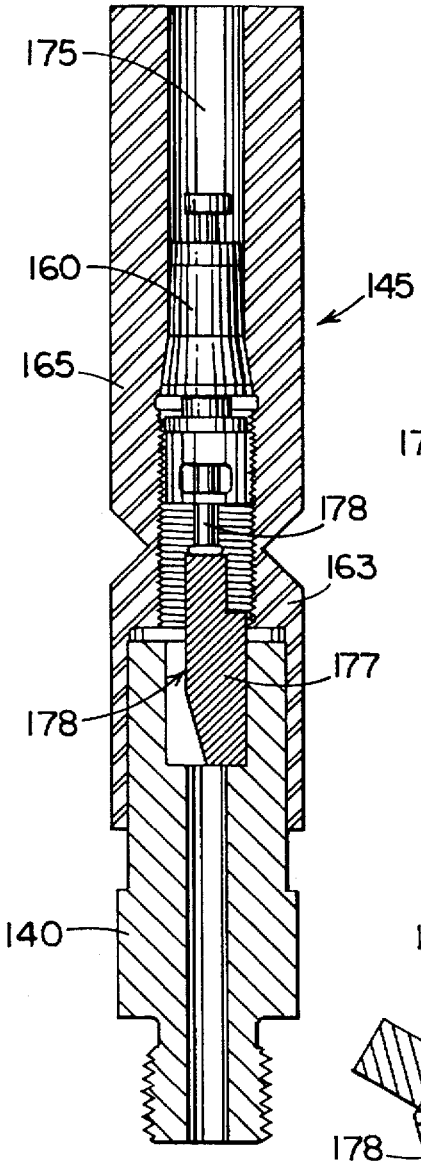
FIG. 11
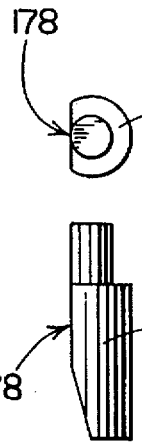
FIG. 12B
FIG. 12A
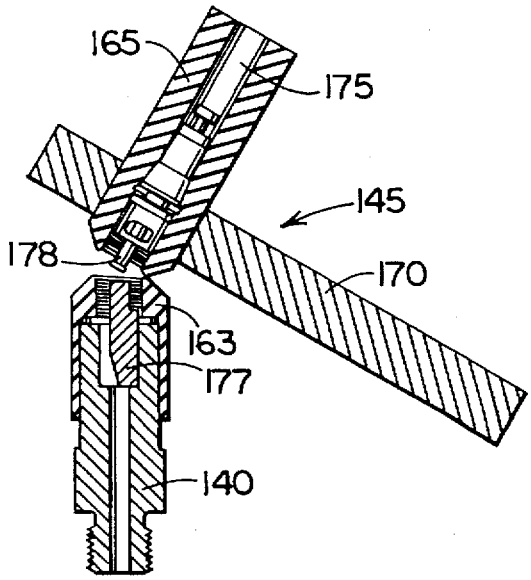
FIG. 13

METHOD AND APPARATUS FOR THE AUTOMATIC RELEASE OF A GAS FROM A PRESSURIZED CARTRIDGE

TECHNICAL FIELD

This invention relates to a method and apparatus for the automatic release of a gas from a pressurized cartridge, and more particularly to a method and apparatus for reliably inflating a signal balloon with an automated and compact mechanism, entirely self-contained in a lightweight and resilient casing.

BACKGROUND OF THE INVENTION

Small pressurized gas cylinders are commercially available for a variety of standard gases. Currently, the devices available for achieving the release of these pressurized cylinders involve mechanisms that use a manually applied force to rupture the cartridge and release the gas contained within. The use of manual force to rupture the cartridge of pressurized gas is undesirable in many situations. Manual methods tend to be unreliable and inconsistent. There is a need for an automatic and reliable device that provides a light weight and compact mechanism for releasing the contents of pressurized gas cartridges.

Emergency or signal balloons require inflation from cartridges of pressurized gas in a reliable and consistent manner. An emergency balloon is a simple and effective distress signal. Search and rescue personnel easily locate these brightly colored and reflective balloons. Additionally, radar reflective features may be added to enhance the "locatability" of emergency balloons. However, in case of an emergency, an injured survivor may not have the ability to operate a complex balloon inflation device, nor read a lengthy instruction on its operation. Past signal balloon inflation devices proclaim to be simple and easy to deploy. Though typically improving over prior technology, they still lack the ease of operation required by a person of little mechanical aptitude or physical strength. This lack of strength or mechanical ability may result from trauma related to the accident or mishap that results in the need for a rescue. Prior devices require an operator to manually puncture a container of pressurized gas to inflate a balloon. Manual puncture methods intrinsically assume the operator can perform a task that requires an aptitude or some training along with an exact measure of strength to properly operate the device.

The manual activation of a signal balloon inflation mechanism requires the operator to perform a task with exactly the measure of strength required. Too much force used in activating the device may break the mechanism, causing the device to fail. Too little force results in an ineffectual or partial activation. Accordingly, a need exists for a signal balloon inflating apparatus that inflates the balloon automatically upon activation, without a manual levering, manual puncturing, manual screwing or in any other way manually forcing the release of pressurized gas from a cartridge or container.

There is also a need for a signal balloon inflator that automatically and reliably inflates larger balloons for emergency locators. Larger balloons require more lift and have a larger volume than typical self-contained signal balloons used for this purpose. However, even with larger balloons, it would be desirable to still use standard pressurized gas cartridges for inflation.

SUMMARY OF INVENTION

The invention provides a method and apparatus for automatically releasing a gas from a pressurized cartridge of the gas.

According to one aspect of the invention, an automatic balloon inflator is provided having a support structure with an upper surface and a bottom plate. The bottom plate has a cartridge mount, a vent and a pin port. The pin port connects to the cartridge mount. A pressurized cartridge, containing a gas stored under pressure, is received into the cartridge mount of the support structure. The pressurized cartridge abuts to the pin port. A piston housing is mounted upon the support structure. The piston housing has an elongated cavity and a plunger port. A piston is received into the elongated cavity of the piston housing. A plunger has a piston contact surface and a puncture pin. The piston contact surface is received into the piston housing through the plunger port, and the puncture pin is received into the pin port in the bottom plate of the support structure. At least a single firing spring, or equivalent means for forcing the piston to engage the plunger. The firing means has a release means for releasing the firing means. When the piston is forced to engage the plunger, the plunger is depressed and the puncture pin is forced to penetrate the pressurized cartridge, releasing the gas contents of the pressurized cartridge through a vent.

The method of the invention includes an initial step of releasing a firing spring from an extended position and moving a piston with the attached firing spring. The moving piston depresses a plunger. The plunger forces a pin to penetrate a gas cartridge. The gas is then released from the gas cartridge through the vent.

According to one aspect of the invention, the apparatus releases the contents of a pressurized cartridge automatically upon activation, without manually forcing the rupture of the diaphragm seal in a pressurized gas cylinder.

According to another aspect of the invention, an emergency balloon inflator is provided that automatically and simultaneously ruptures the diaphragm seals in a plurality of standard gas cartridges to enable the inflation of larger emergency balloons requiring more lift than typical self-contained emergency balloons.

According to yet another aspect of the invention, an emergency balloon inflator is provided that is equipped with a lightweight and reliable self sealing one-way valve attached to the support structure that, after the balloon is filled, can snap off from the support structure.

According to still another aspect of the invention, an emergency balloon inflator is provided with a reliable balloon tether, which feeds a line to the balloon with a minimum possibility of knots and tangles.

The invention will be better understood by reference to the following detailed description taken together with the accompanying drawings.

BRIEF DESCRIPTION OF DRAWINGS

FIG. 10 is an elevational detail view of a one-way valve of an automatic emergency balloon inflator, according to an embodiment of this invention;

FIG. 11 is a partially sectioned elevational detail view of a one-way valve of an automatic emergency balloon inflator, according to an embodiment of this invention;

FIG. 12A is an elevational view of a valve pin of an automatic emergency balloon inflator, according to an embodiment of this invention;

FIG. 12B is a plan view of a valve pin of an automatic emergency balloon inflator, according to an embodiment of this invention;

FIG. 13 is a partially sectioned elevational detail view of a one-way valve and a wrench of an automatic emergency balloon inflator, according to an embodiment of this invention.

DETAILED DESCRIPTION OF SPECIFIC EMBODIMENTS

The invention provides an apparatus for automatically releasing a gas from a pressurized cartridge. An embodiment of this apparatus is an automatic emergency balloon inflator 15 as is shown in FIGS. 1 through 14 herein.

Figure 1:
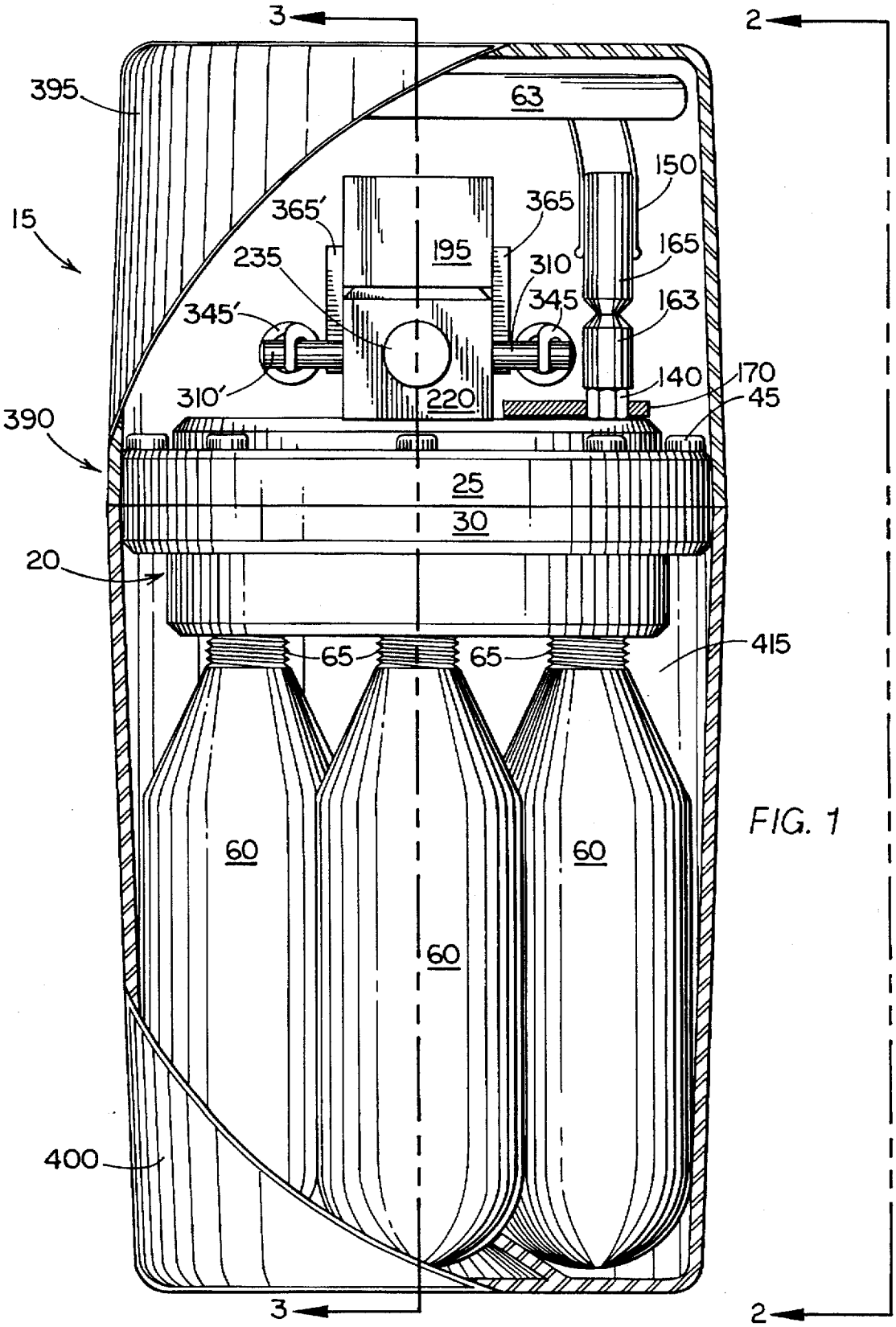
FIG. 1 is a partially sectioned elevational view of an automatic emergency balloon inflator, according to an embodiment of this invention.
Figure 3:
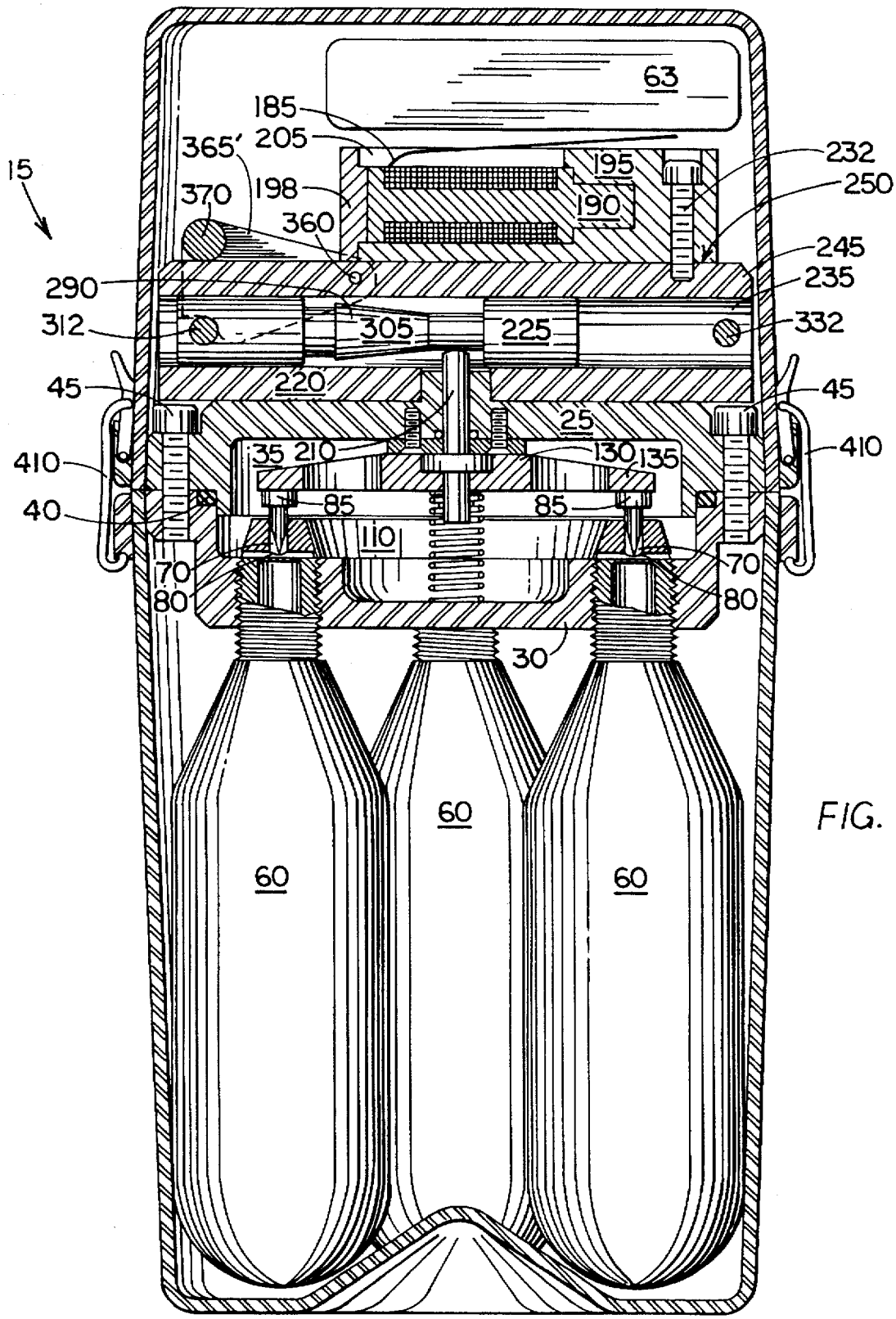
FIG. 3 is a partially sectioned elevational view of an automatic emergency balloon inflator, according to an embodiment of this invention.

FIG. 1 shows a support structure 20 having a top plate 25 and a bottom plate 30. FIG. 3 shows that the top plate and the bottom plate enclose an expansion chamber 35. The support structure is preferably fabricated from a lightweight metal alloy or a resinous plastic material. "Nylatron® GS-63" brand of nylon 6, with molybdenum disulfide cross-links manufactured by DSM Engineering Plastics of Evansville, Ind., performs adequately.

Figure 2:
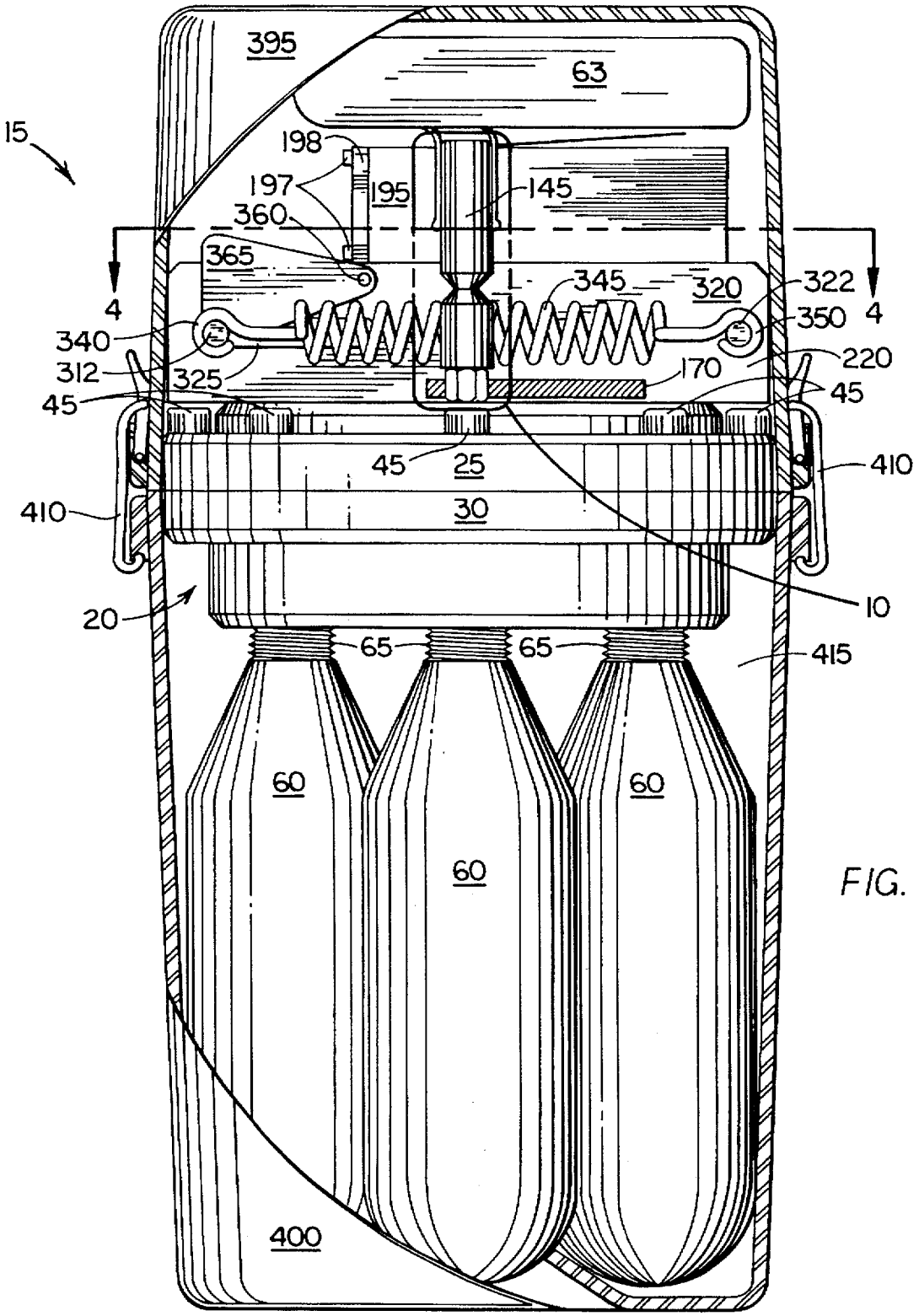
FIG. 2 is a partially sectioned elevational view of an automatic emergency balloon inflator, according to an embodiment of this invention.
Figure 5:
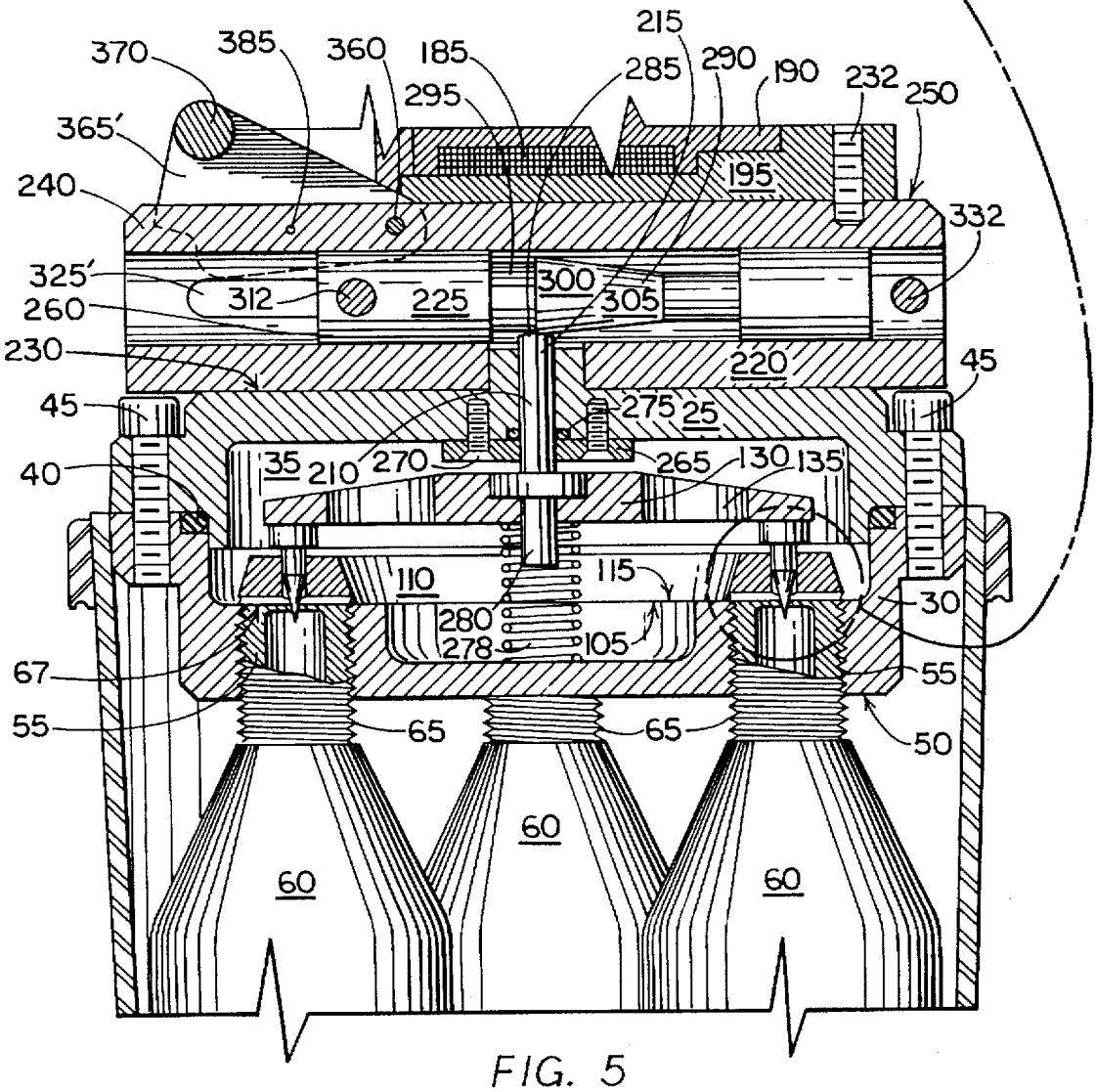
FIG. 5 is a partially sectioned elevational view of a middle portion of an automatic emergency balloon inflator, according to an embodiment of this invention.
Figure 8:
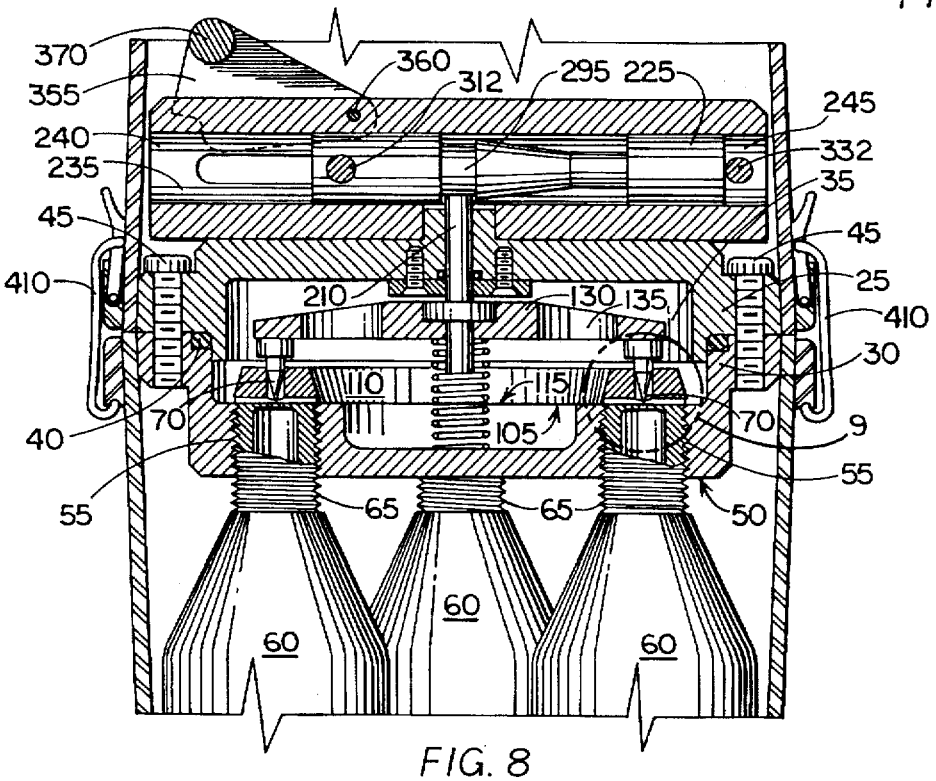
FIG. 8 is a partially sectioned elevational view of a middle portion of an automatic emergency balloon inflator, according to an embodiment of this invention.
Figure 14:
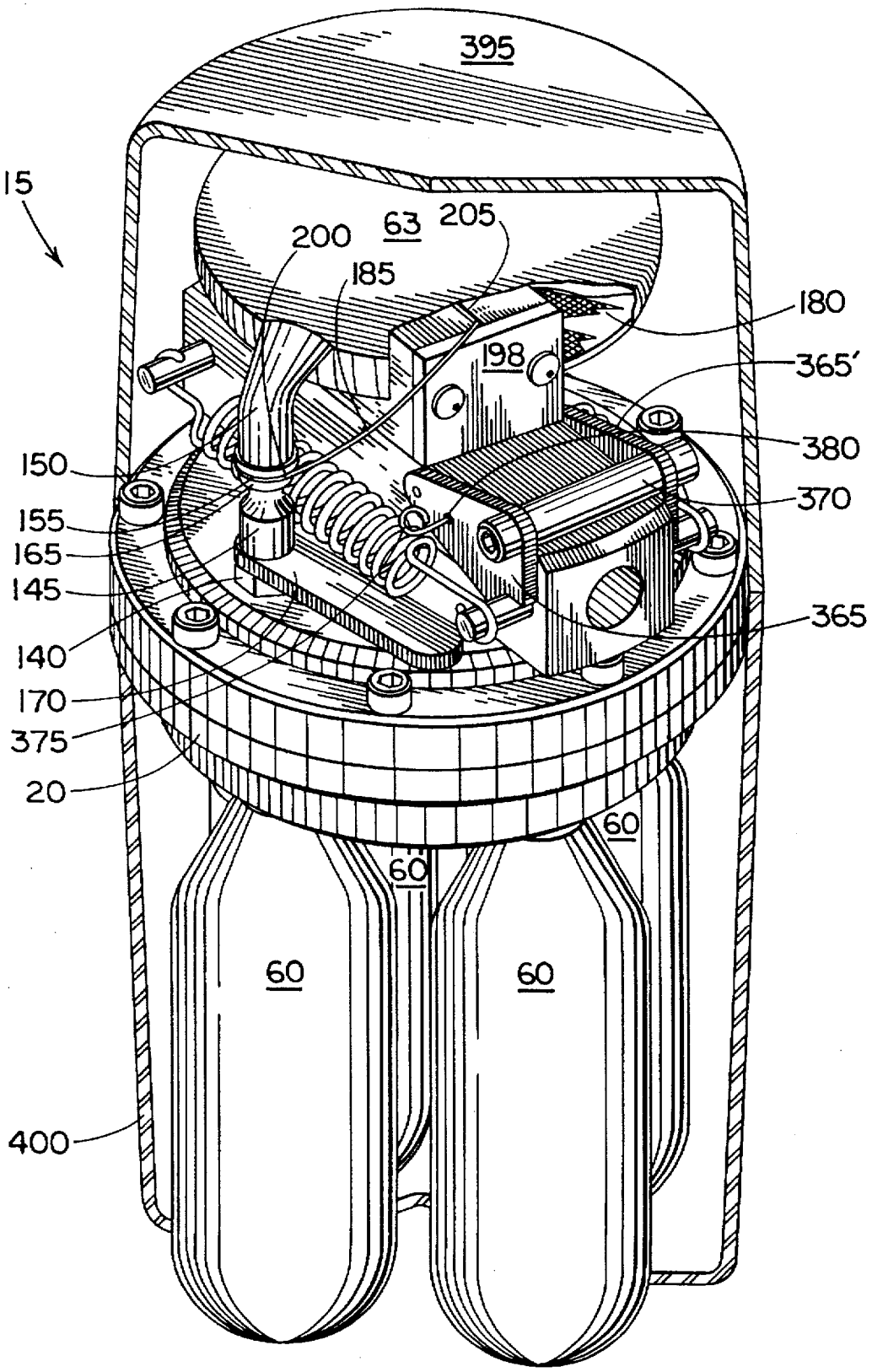
FIG. 14 is a partially sectioned perspective view of an automatic emergency balloon inflator, according to an embodiment of this invention.

The bottom plate 30 sealably connects to the top plate 25 as shown in FIGS. 1 through 3 and in FIGS. 5, 8 and 14. A ring shaped seal 40 shown in FIG. 5, between the top plate and the bottom plate, insures a leak proof seal. Machine screws 45 placed at regular intervals along the perimeter of the support structure hold the top plate and bottom plate tightly together.

The bottom surface 50 of the bottom plate 30 has four cartridge mounts 55 as shown in FIGS. 3, 5 and 8, for receiving pressurized cartridges 60 of a gas. Each of the cartridge mounts is preferably tapped to match the threads of the pressurized cartridge. Liquified gas is also included in the term "pressurized gas" and "gas stored under pressure" as used herein, since many gases can be conveniently stored under pressure in a liquefied state and immediately flash to a gaseous state when released. For use in emergency locator balloons, helium is the preferred gas, as it is considered environmentally safe and chemically inert.

Although the inventors of the present invention contemplate the use of unconventional pressurized cartridges 60, pressurized cartridges of standard design are relatively inexpensive and readily available when compared to custom fabricated equivalents. The preferred pressurized cartridge type is a cylinder. They are easily placed into the automatic emergency balloon inflator 15 and subsequently replaced with ease, by virtue of their uniform size and construction. An additional advantage in the use of standard pressurized cartridges is that most are certified as safe for air transport. Transportation restrictions imposed on nonstandard pressurized gas cartridges render such nonstandard cartridges unusable in this device for many applications. Helium cylinders manufactured by Leland, Ltd., of Bedminster, N.J., (Part No. 496158E Cartridges 2W134 Leland Lot #30034 Japan) are of the standard design and adequate for use in this device.

The standard pressurized cartridges 60 each have a threaded end 65 with a standard diameter and thread that screws securely into the cartridge mount 55 of the support structure 20. The threaded ends of standard pressurized cartridges are ⅝ths of an inch in diameter and threaded with 18 BNC standard threads per inch. Preferably, the cartridge mounts are also ⅝ths of an inch in diameter and threaded with 18 BNC standard threads per inch, to accommodate most standard pressurized cartridges of gas.

The number of pressurized cartridges 60 received into the automatic emergency balloon inflator 15 is variable by the manufacturer of the device. In a preferred embodiment of the automatic emergency balloon inflator, four pressurized cartridges are employed. Four pressurized cartridges of helium gas, as shown in FIG. 14, provide adequate lift for a balloon 63 that is large enough to perform as needed.

Figure 6:
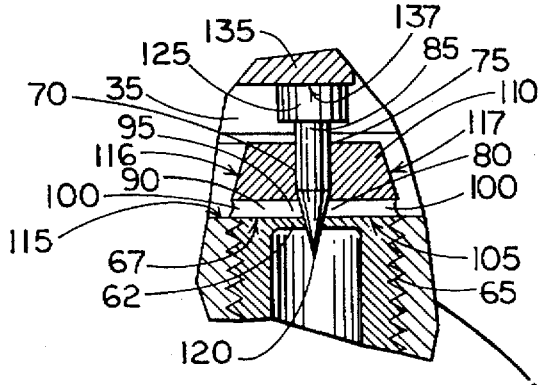
FIG. 6 is a partially sectioned elevational detail view from FIG. 5, of an automatic emergency balloon inflator, according to an embodiment of this invention.

As shown in FIGS. 5 and 6, the threaded end 65 of each pressurized cartridge 60 abuts a terminal surface 67 of the cartridge mount 55. Each terminal surface has a pin port 70. As shown in FIG. 6, each pin port has a top end 75 that is open to the expansion chamber 35, and a bottom end 80 that is open to one of the cartridge mounts. The bottom end of each pin port terminates at the terminal surface of each cartridge mount. Each pin port receives a puncture pin 85. Each puncture pin inserts into the top end of the corresponding pin port.

The bottom end 80 of each pin port, as shown in FIG. 6, also intersects with at least a vent 90. Preferably, the vent begins as a vent groove 95 on the terminal surface 67 of each of the cartridge mounts 55 and then translates into a pair of vent ports 100.

Preferably, as also shown in FIG. 6, the terminal surface 67 of each cartridge mount 55 is a bottom face 105 of a backup ring 110. The bottom face of the backup ring abuts an interior surface 115 of the bottom plate 30. Preferably, machine screws (not shown) attach the backup ring to the interior surface of the bottom plate. The backup ring also preferably includes each of the puncture pin ports 70 and each of the vents 90, so that the vent ports are located on an inner surface 116 and an outer surface 117 of the backup ring and open to the expansion chamber 35.

FIG. 6 shows that each puncture pin 85 has a point 120 and a pin head 125, and is received into one of the pin ports 70. The puncture pins are preferably made of AISI-SAE 3150 nickel-chromium steel, tempered to a Rockwell C-Scale Hardness Number between 55 and 58.

The puncture pins 85 contact a plunger 130 at a pin contact surface 137, as shown in FIG. 5. The plunger has a disk 135, a piston contact 210 and preferably at least a single puncture pin that abuts to the disk. Preferably, to rupture a plurality of pressurized cartridges 60, the plunger has multiple puncture pins, one for each pressurized cartridge attached to the support structure 20. Although the plunger and the puncture pins both could be cast or milled from the same single piece of material, in the preferred embodiment, the puncture pin is a separate component from the plunger. The puncture pins are not attached to the plunger to prevent the multiple puncture pins from binding when the plunger is activated. Additionally, to maintain the puncture pins from moving within the pin port prior to the activation of the plunger, crushable foam rings (not shown) are preferably placed between the pin heads 125 and the backup ring 110, surrounding each puncture pin. Alternatively, the crushable foam could be a rubber or sponge material. Also alternatively, the crushable foam could be in the form of a gasket (not shown) between the pin contact surface 137 and the backup ring, penetrated by the puncture pins so that the pin heads rest upon the gasket.

Figure 9:
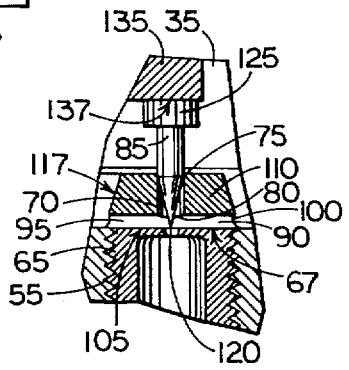
FIG. 9 is an elevational detail view of an automatic emergency balloon inflator, according to an embodiment of this invention.

Preferably, the automatic emergency balloon inflator 15 uses a multiple of pressurized cartridges 60. A preferred embodiment with four pressurized cartridges of gas, and as shown in FIGS. 6 and 9, has correspondingly four puncture pins 85 received into the four pin ports 70. The pin head 125 on each of the puncture pins 85 contact the pin contact surface 137 on the disk 135 of the plunger 130.

When the pressurized cartridges 60 are ruptured as shown in FIGS. 5 and 6, their contents are released into the expansion chamber 35. A valve connection 140 of a one-way valve 145 is received by the support structure 20 as shown in FIGS. 2, 10 and 14. As shown in FIG. 14, an inlet 150 of the balloon 63 is attached to the one-way valve. Preferably, a clip 155, prevents the inlet of the balloon from detaching from the one-way valve and from leaking around the one-way valve.

As shown in FIG. 11, the one-way valve also includes a valve core 160, a break-off section 165, a remainder 163 and preferably a wrench 170. The one-way valve allows the gas to escape from the expansion chamber 35 and into the balloon 60. The one-way valve preferably has a hollow interior 175 that is partially threaded to receive the valve core.

A "Schrader" type valve core is the preferred valve core 160. The Schrader type valve core is a standard valve core, universally used for most vehicle tires and bicycle tubes. This type of valve core, though reliable, might not withstand a high pressure shock potentially occurring at the rupture of the pressurized cartridges 60, if the pressurized contents were directly vented to the valve connection 140. The contents are also chilled from sudden expansion, when released from the pressurized cartridges. The expansion chamber serves to equalize the pressure and temperature of the expanding contents of the pressurized cartridges.

If the balloon 63 were not required, the contents of the pressurized cartridges could to be released directly to an external environment (not shown). The expansion chamber 35 would not be required in this situation, since there would be no need for pressure or temperature equilibration. The vents 90 in the bottom face 105 of the backup ring 110 could then connect the bottom ends 80 of the pin ports 70 directly to the external environment.

The valve core 160 is preferably contained within the break-off section 165 of the one-way valve 145. After the balloon 63 is filled, the wrench 170 is used to snap off the break-off section. This separation of the balloon that is attached to the break-off section from the remainder 163 of the one-way valve that is attached to the valve connection 140, could be achieved without levering with the wrench. However, the use of a wrench, integrally attached to the one-way valve, affords a consistent and easy separation of the break-off section, from the remainder of the one-way valve. The one-way valve prevents gas from escaping from the balloon, after the balloon is filled and the break-off section is separated from the remainder of the one-way valve.

FIG. 11 shows the valve core 160 held in an open position by a valve pin 177 placed into the hollow interior 175 of the one-way valve 145. The valve pin depresses the valve stem 178 of the valve core while the break-off section 165 is still connected. The valve pin is shown in detail in FIGS. 12A and 12B. The valve pin has a flat face 178 that allows gas to pass through the hollow interior of the one-way valve by-passing the valve pin. This configuration allows the balloon 63 to fill, while the break-off section is connected to the remainder of the one-way valve.

The balloon 63 is sized to accommodate the pressurized contents of the cylinders, and be resistive to puncturing, rupturing or bursting due to additional expansion that will normally occur when the balloon rises upon release. Also, the balloon is preferably light weight and designed with optical and reflective properties to make it easily located by a searcher. Radar locatability is another desirable feature. As shown in FIG. 14, mylar coated strips 180 within the balloon aid in radar location. Thin metal strips can also accomplish the same effect.

After release of the balloon, a tether line 185 keeps the balloon 63 connected to the support structure 20. As shown in FIG. 3, the tether line is wound to a spool 190 enclosed in a spool housing 195. The tether is preferably a braided lightweight line of high strength but low weight and diameter. Gorilla Braid™ brand of 20 pound test fishing line manufactured by Berkley of Spirit Lake, Iowa, is preferred, however a 10 pound test line is adequate. The spool housing is also preferably fabricated from Nylatron® GS-63 and the spool preferably made from aluminum. As shown in FIG. 14, the lead end 200 of the tether attaches to the break-off section 165 of the one-way valve 145. The spool rotates about its centerline to reel out the tether line that feeds from the spool through a longitudinal slit 205 in the spool housing. The approximately horizontal orientations of the spool and longitudinal slit allows the tether line to feed through the longitudinal slit with a minimum of tangles and knots. The tether line maintains a connection between the balloon and the spool housing as the balloon rises to a height that is limited by the length of the tether line. The Nylatron® GS-63 spool housing acts a lubricated bearing, allowing the spool to rotate freely about its centerline within the spool housing.

The balloon 63 is filled by puncturing the pressurized cylinders 60. As shown in FIGS. 5 and 6, a downward force on the plunger 130 forces the disk 135 of the plunger downward and correspondingly forces the puncture pins 85 to puncture the pressurized cylinders. A preferred automatic mechanism to force down the plunger includes the use of a piston contact 210 as a part of the plunger. The piston contact 210 extends from the disk's center.

Although the piston contact 210 and the disk 135 both could be cast or milled from the same single piece of material, in the preferred embodiment, the piston contact is a separate component from the disk. The piston contact penetrates through the top plate 25 of the support structure 20 and into a plunger port 215 of a piston housing 220, to contact a piston 225.

The piston housing mounts upon the support structure 20, as shown in FIG. 5. Preferably, the piston housing attaches to an upper surface 230 of the top plate 25 of the support structure by machine screws (not shown). The piston housing has an elongated cavity 235 within, for receiving the piston. The piston housing has a tail end 240 and a head end 245. Preferably, the elongated cavity runs the entire length of the piston housing, from the tail end to the head end.

As shown in FIGS. 3 and 5, the spool housing is preferably mounted to a top surface 250 of the piston housing 220 by machine screws 232, but could be mounted upon the support structure 20 in any convenient position.

The piston 225, received into the elongated cavity 160 as shown in FIG. 5, has a head 255 and a tail 260. The piston is preferably made of a tool grade steel alloy, most preferably AISI-SAE 3150 nickel-chromium steel, tempered to a Rockwell C-Scale Hardness Number between 55 and 60. The piston has a centerline (not shown) that runs the entire length of the piston. Preferably, the piston is symmetric about the centerline, enabling it to be manufactured on a metal lathe or similar machine.

The head end 245 of the piston housing 220 is also defined as the end of the piston housing toward which the piston travels when it is fired. The piston housing is preferably fabricated from a lightweight metal alloy or a resinous plastic material. Again, Nylatron® GS-63 is the most preferred material. When the piston housing 220 is fabricated of Nylatron® GS-63, it performs as a bearing. This enables the piston to slide smoothly within the elongated cavity, thus avoiding any initial or periodic requirement for lubrication.

To prevent the leakage of gas contained by the expansion chamber 35 through the penetration made through the top plate 25 of the support structure 20 by the piston contact 210, a retainer ring 265 is attached to the top plate, preferably by retainer ring screws 270, as shown in FIG. 5. Most preferably, four retainer ring screws are employed. The retainer ring is preferably made of 303 stainless steel. The retainer ring holds a plunger O-ring 275 in place. The plunger O-ring is preferably made of rubber or a similarly resilient material.

A recoil spring 278 maintains an upward force upon the plunger 130, forcing the puncture pins 85 to retract from the pressurized cartridges at their first opportunity. As shown in FIG. 5, the recoil spring is located at the center of the plunger, sandwiched between the disk 135 and the bottom plate 30 of the support structure 20. The piston contact 210 of the plunger preferably includes a bottom pillar 280 that passes through the disk 135 and extends into the interior of the recoil spring. The bottom pillar serves to prevent the release spring from shifting away from the center of the plunger.

The piston contact 210 of the plunger 130 is received through the center of the retainer ring 265 and the plunger O-ring 275, as shown in FIG. 5. The piston contact terminates with a piston contact surface 285. The piston contact surface abuts to the piston 225. The plunger port 215 in the piston housing 220 receives the plunger. The plunger port is approximately located on a line (not shown) perpendicular to the centerline (not shown) of the piston, and penetrates through the support structure 20 to the expansion chamber 35.

As also shown in FIG. 5, the piston 225 includes a wedge shaped portion 290 and a plunger rest 295. The wedge shaped portion has a wide end 300 and a narrow end 305. The plunger rest is located toward the tail 260 of the piston relative to the wedge shaped portion. The wedge shaped portion is oriented with its narrow end located toward the head of the piston. The wide end of the piston's wedge shaped portion is located immediately adjacent to the plunger rest.

When the piston 225 is fired, it moves laterally within the elongated cavity 235, toward the head end 245 of the piston housing 250. The wedged shaped portion 290 of the piston then engages the piston contact surface 285 of the plunger 130, thereby depressing the plunger as the wide end 300 of the wedge shaped portion moves to engage the piston contact surface.

Figure 4:
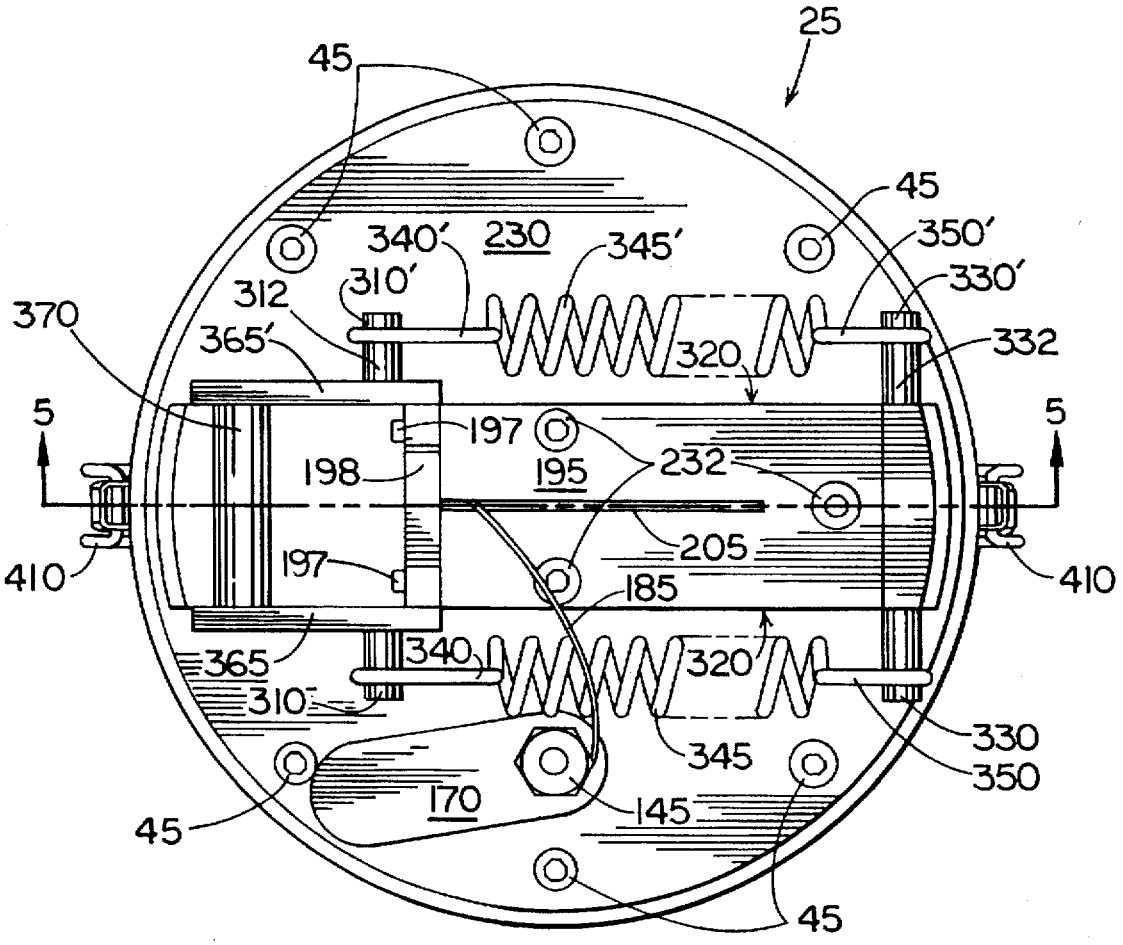
FIG. 4 is a plan view of an automatic emergency balloon inflator with a top cover and a balloon removed, according to an embodiment of this invention.
Figure 7:
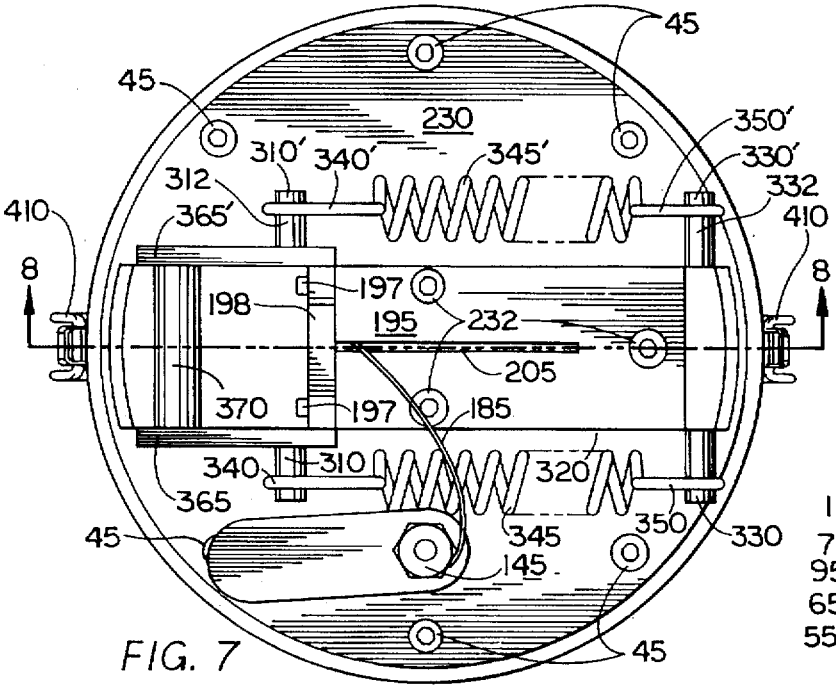
FIG. 7 is a plan view of an automatic emergency balloon inflator with a top cover and a balloon removed, according to an embodiment of this invention.

As shown in FIGS. 1, 4 and 7, the tail 260 of the piston 225 has at least a single spring post 310 and preferably two spring posts 310 and 310'. The two spring posts are preferably the opposite ends of a first steel rod 312. The first steel rod is preferably inserted into a spring post hole penetration 315 drilled through the tail of the piston, as shown in FIG. 5, along a line perpendicular to the centerline (not shown) of the piston.

As shown in FIGS. 2, 4, 5 and 7, each of the spring posts 310 and 310' penetrates a side, 320 and 320' of the piston housing 220, through post slots 325 and 325', respectively. The post slots in the piston housing are provided to allow the piston to travel within the elongated cavity 235 of the piston housing.

Additionally, the head end 245 of the piston housing 220 has at least a single anchor 330 and preferably two anchors 330 and 330'. Like the spring posts 310 and 310', the two anchors are preferably the opposite ends of a second steel rod 332. Here the second steel rod is preferably inserted into an anchor hole penetration 335 drilled through the head end of the piston housing, along the line perpendicular to the centerline (not shown) of the piston. Each of the anchors penetrate a side 320 and 320' of the piston housing.

Preferably, the centerline (not shown) of the piston 225, the spring posts 310 and 310', the anchor 330 and 330', and the post slots 325 and 325' all lie in the same plane. A first end 340 of a firing spring 345 attaches to the spring post. Preferably two firing springs 345 and 345' each having a first end 340 and 340' are used, one attaching to each of the spring posts. Each of the firing springs are typical extension springs, preferably 10 gauge, 19 coil, ½ inch springs, each made of 18-8 stainless steel. Each of the firing springs also has a second end 350 and 350'. Each of the second ends of the spring attaches to a respective anchor.

A trigger 355 releases the firing spring from an extended position, as shown in FIGS. 7 and 8. Preferably, the trigger is hingeably attached to the piston housing 220 at a pair of pivots 360 and 360'. The trigger has a pair of support arms 365 and 365' that each engage one of the spring posts 310 and 310', retaining the spring posts in a position near the tail end 240 of the piston housing 220. The support arms are connected across the top surface 250 of the piston housing by a trigger bar 370.

A safety pin 375, as shown in FIG. 14, is preferably inserted into at least one of the support arms 365, locking the trigger 370 in place. The safety pin is received into an arm pin hole 380 in the support arm and aligns with a housing pin hole 385 drilled into the piston housing, as shown in FIG. 5.

Preferably, a housing 390, as shown in FIG. 1, completely encapsulates the support structure, the pressurized cartridges 60, the piston housing 220, the spool housing 195 and the balloon 63. The housing is preferably a molded plastic. High impact thermosetting plastic formed in a vacuum forming process performs adequately. The housing includes a top cover 395 and a bottom cup 400. The bottom cup is attached to the support structure 20 by four small screws 405 (not shown). A pair of latches 410 and 410', as shown in FIGS. 2, 4, 7 and 8, connect the bottom cup to the top housing. Southco brand, No. 97, Series 50, light duty, stainless steel, over-center draw latches, made by Southco, Inc. of Concordville, Pa., perform adequately.

In a preferred operational method of the automatic emergency balloon inflator 15, an operator begins by releasing the latches 410 and 410' to disengage the top cover 395 of the housing 390. The top cover is removed and the automatic emergency balloon inflator 15 is oriented in preparation for the release of the balloon 63. The operator pulls the safety pin 375 from the housing pin hole 385 and the arm pin hole 380. The operator then lifts the trigger bar 370. The trigger hinges upward on the pair of pivots 360 and 360' and the support arms 365 and 365' disengage from the spring posts 310 and 310', releasing the firing springs 345 and 345', respectively. If only a single spring post is included, then the trigger may only require a single support arm.

The firing springs 345 and 345' immediately contract upon release, pulling the spring posts 310 and 310' along the post slots 325 and 325', forcing the piston 225 to travel toward the tail end 240 of the piston housing 220. The piston contact 210 follows the wedged shaped portion 290 of the piston 225 as the piston travels.

Initially, the piston contact 210 is in a starting position as shown in FIG. 3. In cooperation with the piston contact, the disk 135 and the puncture pins 85 are also initially in the starting position. The piston contact begins at the narrow end 305 of the wedge shaped portion 290 and is pushed downward as the piston 225 travels. The downward motion of the plunger 130 and connected puncture pins 85, as forced by the piston contact, is herein referred to as a puncture stroke. The puncture stroke forces the plunger down and the puncture pins are each forced down their respective pin ports 70 and into the pressurized cartridges 60 of gas that abut to the bottom ends 80 of the pin ports.

Preferably, the pressurized cartridges 60 have a diaphragm 62 sealing the pressurized cartridges at the terminal surface 67 on their threaded ends 65, as shown in FIG. 6. Typically, the diaphragms are metal but any thin material that could be perforated by the puncture pins 85 could be used. The puncture pins perforate the diaphragms and continue past the diaphragms to the bottom of the puncture stroke, forming a hole in the diaphragm 62 large enough for the pressurized contents of the pressurized cartridges to readily escape.

FIG. 5 shows a partially sectioned view of a portion of the emergency balloon inflator 15 at the bottom of the puncture stroke. The bottom of the puncture stroke is reached when the piston contact 210 travels downward, engaged by the wide end 300 of the wedge shaped portion 290 of the piston 225.

Prior to firing the piston 225, the plunger rest 295 of the piston is located proximate to the tail end 240 of the piston housing 220. When the piston is fired, the piston travels toward the tail end of the piston housing. The wedge-shaped portion 290 of the piston travels past the piston contact 210 and the piston contact rises into the plunger rest. In the plunger rest, the plunger 130 is in a rest position as shown in FIG. 8. The rest position of the plunger approximates the starting position of the plunger, as described above.

The piston contact 210 preferably includes a bottom pillar 280 that sets within the recoil spring 278. The bottom pillar serves to prevent the recoil spring from shifting away from the center line (not shown) of the plunger 130. The recoil spring 278 maintains an upward force upon the plunger and so forces the plunger into the plunger rest 295. The puncture pins 85 are preferably screwed to the disk 135 of the plunger, but they do not need to be attached to the disk. The plunger travels to the rest position as allowed by the piston contact received into the plunger rest as forced by the recoil spring. The puncture pins are also forced to retract to a point proximate to their starting position, back up the pin ports 70 toward the pin contact surfaces 137, also aided by the compressed gas escaping from the pressurized cartridges 60. After the piston 225 has completed its movement upon firing, as shown in FIG. 8, the narrow end 305 of the piston's wedge shaped portion 290 is located proximate the head end 245 of the piston housing 220.

After the diaphragms 62 of the pressurized cartridges 60 are perforated, the puncture pins 85 immediately retract to the rest position. The gaseous contents of the pressurized cartridges 60 escape through the vents 90 into the expansion chamber 35 within the support structure 20. The expansion chamber allows the pressure of the gas to be reduced before entry into the balloon 63. This avoids the possibility of causing the balloon to rupture or the one-way valve 145 to fail due to the injection of high pressure gas into the balloon through the one-way valve. The one-way valve further throttles the gas into the balloon. The balloon quickly fills with the gas from the pressurized cartridges.

The easy and automated activation of the emergency balloon inflator 15 allows a person of little mechanical aptitude or physical strength to operate the self contained device. This lack of strength or mechanical ability may be a result of trauma directly related to the accident or mishap that creates in the need for an emergency rescue. Prior balloon inflation devices required an operator to manually puncture a container of pressurized gas to inflate a balloon. The emergency balloon inflator of the present invention does not require that the operator possesses an aptitude or some training along with an exact measure of strength to properly operate the device. The improved emergency balloon inflation device, as described herein, only requires the operator to pull the safety pin 375 and lift the trigger bar 370 to activate the device. The emergency balloon inflator is automatically activated at the "flick of a switch".

When the balloon 60 is filled and the gas within the balloon is at approximately the same pressure as the remaining gas in the expansion chamber 35, the operator lifts the wrench 170 attached to the one-way valve 145, to engage the break-off section 165. As shown in FIG. 12, the operator can easily lever the wrench to snap the break-off section from the valve connection 140 that remains attached to the support structure 20. As the break-off section is snapped, the valve pin 177 disengages from the valve stem 178 of the one-way valve.

Once the valve stem 178 is released form the valve pin 177, the one-way valve 145 seals. The break-off section 165 includes the one-way valve. With the one-way valve, the gas is prevented from escaping from the balloon 63. The snap-off one way valve allows the balloon to detach from the support structure 20 in a simple and reliable manner. Previous emergency locator balloon systems employed separable valves, but these valves were substantially heavier in design. In prior valve systems the balloon was left with a heavy pneumatic fitting that required the trade off of critical balloon lift or a custom valve that had a high potential to leak. The incorporation of a standard Schrader valve offers a light weight and reliable valve system, overcoming the problems encountered in attempting to provide a light weight and reliably performing one-way valve system.

The balloon 63 immediately rises after being detached from the support structure 20, tethered by the tether line 185. The tether line is preferably approximately 100 meters in length, to adequately rise above surrounding trees and terrain features. At sea, the height of the balloon provides a further horizon of sight from which the balloon can be detected.

To achieve better performance of the emergency balloon inflator 15 for marine applications, the interstitial space 415 in the bottom cup 400 can be filled with a high density closed cell foam (not shown) to insure buoyancy should the device become submerged. The closed cell foam also provides additional insulation around the pressurized cartridges 60 of gas as a barrier against possible temperature extremes and as impact protection for the pressurized cartridges.

If recovered after being fired, the emergency balloon inflator 15 is reusable. The spring posts 310 and 310' are pulled back to their starting position and the support arms 365 and 365' of the trigger 355 are reset down to engage them. The safety pin 375 is then reinserted into the arm pin hole 380 and the corresponding housing pin hole 385. The pressurized cartridges 60 can be removed and recycled or refilled, by unscrewing the small screws 405 that hold the bottom cup 400 to the support structure 20, and removing the bottom cup, exposing the pressurized cartridges. New pressurized cartridges are inserted and screwed into the threaded cartridge mounts 55. The bottom cup is then reattached to the support structure by the small screws. A new spool 190 of tether line 185 is placed into the spool housing 195 by unscrewing a pair of tether spool housing screws 197 and removing a spool cover 198. The spent spool is removed and the new tether line wound to the spool. The rewound spool is replaced into the spool housing and the spool cover reattached by screwing in the tether spool housing screws. A new one way valve 145 with the integral wrench 170 is inserted onto the valve 140 connection on the support structure 20. A new balloon 63 is placed into the top cover 395 of the housing after attaching the inlet 150 of the balloon to the one-way valve. The lead end 200 of the tether is attached to the one way valve and finally, the top cover is relatched to the bottom cup of the housing 390. The emergency locator balloon inflator is now ready for redeployment.

This device is especially suited use in aircraft and marine applications, or in any application, such as back-country hiking and hunting, where compact and reliable emergency locators are desired. In back-country applications, a strap (not shown) couldbe included to secure the emergency locator balloon inflator 15 to the waist of a hiker or to facilitate the attachment of the device to a pack. The strap is conceived to also be of use in securing the device to the interior of an airplane or boat for safe transit prior to deployment.

This device has possible uses beyond the deployment of emergency balloons. The device as herein described could easily be modified to deploy weather transponding balloons in remote locations. The device's light weight and simplicity in design make it ideal for situations when a self-contained field maintainable and reusable device is needed.

Alternatively, an electro-mechanical trigger is conceived, replacing the trigger 355 that releases the firing spring 345. The trigger could be activated by remote control, a computer or microprocessor link, a small explosive charge, a solenoid switch or any such means to achieve remote activation.

Also alternatively, this device presents a mechanism with a fundamental application in any situation that requires the simultaneous release of a gas contained in multiple containers or cartridges. The fail safe design of this device lends it to fire safety applications involving the disbursement of fire retardant gases such as halon or carbon dioxide without the need for of electrical power. Emergency oxygen in air locks, for undersea and aerospace applications are also conceived. Additionally, military applications that require the mixing of two or more agents contained in separate cartridges could also employ this device.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. It is therefore intended that such changes and modifications be covered by the appended claims that follow.

What is claimed is:

1. An apparatus for automatically releasing a gas from a pressurized cartridge of the gas, which comprises:

a support structure having an upper surface and a bottom surface, the bottom surface having a plurality of cartridge mounts, a plurality of pin ports and at least a single vent, each one of the plurality of pin ports open to the plurality of cartridge mounts, and the vent adapted to be open to an external environment;

a plurality of pressurized cartridges, each containing a gas stored under pressure, each one of the pressurized cartridges of gas received securely into one of the plurality of cartridge mounts of the support structure, each one of the pressurized cartridges abutted to one of the plurality of pin ports;

a piston housing mounted to the upper surface of the support structure, the piston housing having an elongated cavity;

a piston receivable into the elongated cavity of the piston housing, a plunger having a plurality of piston contact surfaces and a plurality of puncture pins, the piston contact surface receivable into the piston housing, and each of the plurality of puncture pins receivable into the bottom surface of the support structure;

a firing means for moving the piston within the elongated cavity of the piston housing to engage the plunger contact surface;

a puncturing means for activating the plunger, forcing each one of the puncture pins to penetrate each of the corresponding pressurized cartridges of gas, simultaneously releasing the gas through the vent, the puncturing means activatable by the firing means; and a release means for releasing the firing means to activate the puncturing means.

2. An apparatus for automatically releasing a gas from a pressurized cartridge of the gas, which comprises:

a support structure having a top plate and a bottom plate;

the bottom plate sealably connected to the top plate, the bottom plate having a cartridge mount and a pin port, the pin port connected to the cartridge mount;

an expansion chamber enclosed between the top plate and the bottom plate;

a pressurized cartridge, containing a gas stored under pressure, the pressurized cartridge received securely into the cartridge mount of the support structure, the pressurized cartridge abutted to the pin port;

a piston housing mounted upon the support structure, the piston housing having a tail end and a head end, an elongated cavity and a plunger port, at least a single anchor attached to the head end of the piston housing;

a piston receivable into the elongated cavity of the piston housing, the piston having a length, a center line, and a wedge shaped portion, the wedge shaped portion having a wide end and a narrow end, the narrow end of the piston located near the head end of the piston housing, the wide end located near the tail end of the piston housing, and the plunger port located approximately along a line perpendicular to the center line of the piston;

a plunger having a piston contact surface and a puncture pin, the piston contact surface receivable into the piston housing through the plunger port, and the puncture pin receivable into the pin port in the bottom plate of the support structure;

a firing spring having a first end and a second end, the second end attached to the anchor on the head of the piston housing, the first end attached to the piston;

a firing means for moving the piston within the elongated cavity of the piston housing to engage the plunger contact surface;

a puncturing means for activating the plunger, forcing the puncture pin to penetrate the pressurized cartridge of gas, releasing the gas, the puncturing means activatable by the firing means; and a release means for releasing the firing spring from an extended position to activate the puncturing means.

3. The apparatus of claim 2, further including a safety means for preventing the release means from releasing the firing spring from the compressed position, unless the safety means is disengaged by the operator.

4. The apparatus of claim 2, wherein multiple pressurized cartridges of gas are simultaneously released, the cartridge mount is a plurality of cartridge mounts, the pin port is a plurality of pin ports, each one of the pin ports is connected to one of the cartridge mounts, the pressurized cartridge is a plurality of pressurized cartridges, each one of the pressurized cartridges is received securely into one of the cartridge mounts of the support structure, each one of the pressurized cartridges is aligned with one of the pin ports, the puncture pin is a plurality of puncture pins, and each of the puncture pins is receivable into one of the pin ports in the bottom plate of the support structure.

5. The apparatus of claim 2 wherein the cartridge of pressurized gas is sealed with a penetrable diaphragm, and the puncture pin penetrates the diaphragm when the firing means releases the firing spring.

6. The apparatus of claim 2, further comprising:

a balloon;

an expansion chamber included in the support structure, for receiving the pressurized gas released from the pressurized cartridge; and a valve connection for filling the balloon when the pressurized gas is released into the expansion chamber, the valve connection penetrating through the support structure into the expansion chamber, and the balloon attached to the value connection.

7. The apparatus of claim 6, wherein the valve connection receives a one-way valve.

8. The apparatus of claim 7, wherein the one-way valve is separable into a sealable break-off section attached to the balloon and a remaining section attached to the valve connection.

9. The apparatus of claim, 7, wherein the one-way valve is a Shrader type one-way valve.

10. A method for automatically releasing a gas from a multiple of pressurized cartridges of a gas, comprising the steps of:

releasing a firing spring from an extended position;

moving a piston with the attached firing spring;

forcing the moving piston to engage and depress a plunger;

forcing a plurality of puncture pins each attached to the plunger, to each penetrate one of a multiple of gas cartridges; and simultaneously releasing the gas from each one of the multiple of gas cartridges through a minimum of a single vent.

11. A method of claim 10, for automatically releasing a gas from a pressurized cartridge of a gas, additionally comprising the step of filling a balloon with the gas released through the vent.

12. A method of claim 11, for automatically releasing a gas from a pressurized cartridge of a gas, additionally comprising the steps of:

providing a spool housing;

receiving a spool, having a centerline oriented approximately horizontal, within the spool housing;

winding a tether line onto the spool;

attaching the tether line to the balloon; and reeling out the tether line as the balloon rises.

13. A method of claim 12, for automatically releasing a gas from a pressurized cartridge of a gas, additionally comprising the steps of:

connecting a one-way valve between the vent and the balloon; and separating the one-way valve into a sealable break-off section attached to the balloon and a remaining section attached to the vent.

* * * * *